US005238767A

United States Patent [19]

Horiie

[11] Patent Number: 5,238,767

[45] Date of Patent: Aug. 24, 1993

[54] RELEASING COMPOSITION FOR ELECTROPHOTOGRAPHIC TONER

[75] Inventor: Takafumi Horiie, Kyoto, Japan

[73] Assignee: Sanyo Chemical Industries, Ltd., Kyoto, Japan

[21] Appl. No.: 559,209

[22] Filed: Jul. 30, 1990

[30] Foreign Application Priority Data

| | | | |
|---|---|---|---|
| Jul. 31, 1989 | [JP] | Japan | 1-199755 |
| Sep. 12, 1989 | [JP] | Japan | 1-236644 |
| Nov. 14, 1989 | [JP] | Japan | 1-295371 |
| Nov. 28, 1989 | [JP] | Japan | 1-308445 |
| Dec. 13, 1989 | [JP] | Japan | 1-323507 |
| Apr. 20, 1990 | [JP] | Japan | 2-105702 |

[51] Int. Cl.[5] ..... G03G 9/00

[52] U.S. Cl. ..... 430/110; 430/109; 430/904

[58] Field of Search ..... 430/109, 110, 904

[56] References Cited

U.S. PATENT DOCUMENTS

| | | | |
|---|---|---|---|
| 3,859,386 | 1/1975 | Mainford | 525/301 |
| 4,146,529 | 3/1979 | Yamamoto et al. | 524/262 |
| 4,254,207 | 3/1981 | Landoll et al. | 430/109 |
| 4,734,479 | 3/1988 | Inoue et al. | 524/760 |
| 4,810,612 | 3/1989 | Ueda et al. | 430/110 |
| 4,820,604 | 4/1989 | Manca et al. | 430/110 |
| 4,845,007 | 7/1989 | Hyosu et al. | 430/137 |
| 4,849,316 | 7/1989 | Kawaski et al. | 430/137 |
| 4,853,311 | 8/1989 | Tavernier et al. | 430/106 |
| 4,876,169 | 10/1989 | Gruber et al. | 430/110 |
| 5,039,736 | 8/1991 | Fujiki | 524/730 |

FOREIGN PATENT DOCUMENTS

| | | |
|---|---|---|
| 0314158 | 10/1988 | European Pat. Off. . |
| 1149075 | 6/1966 | United Kingdom . |
| 1442835 | 7/1976 | United Kingdom . |
| 1590567 | 5/1978 | United Kingdom . |
| 2100873 | 6/1982 | United Kingdom . |
| 2104841 | 7/1982 | United Kingdom . |

*Primary Examiner*—Marion E. McCamish
*Assistant Examiner*—Stephen C. Crossan
*Attorney, Agent, or Firm*—Oblon, Spivak, McClelland, Maier & Neustadt

[57] ABSTRACT

Releasing compositions, comprising at least one polyolefinic resin selected from the group consisting of

[1] a polypropylene resin having a melt viscosity of at most 1000 cps at 160° C. and having an isotactic content of at least 90%,

[2] an organo silane-modified polyolefin resin, and

[3] an organo fluorine-modified polyolefin resin, are suitable for use in electrophotographic toners and are capable of providing high hot offset temperature without reducing flowability of toners.

18 Claims, No Drawings

RELEASING COMPOSITION FOR ELECTROPHOTOGRAPHIC TONER

BACKGROUND OF THE INVENTION

1. Field of the Invention

This invention relates to a releasing composition suitable for electrophotographic toner (hereinafter referred to as toner). More particularly, it relates to a releasing composition for toner, particularly suitable for that used in copy machines or printers of heat fixation type.

2. Description of the Prior Art

Toners, in heat fixation methods, are fixed on a substrate with a heated roller. In these methods, it is desired that the minimum temperature for fixing (hereinafter referred to as MF) is low and the hot offset temperature (the temperature causing offset to the heated roller) (hereinafter referred to as HO) is high. In order to meet these two requirements, it has been heretofore proposed to add a releasing agent such as low molecular weight polypropylene during the preparation of toners to attain an elevated HO (such as JPN Patent Publications No. 3304/1977). In these techniques, there are drawbacks, that use of such a releasing agent as low molecular weight polypropylene results in poor flowability of toners, and that sufficiently high HO is not always obtained.

SUMMARY OF THE INVENTION

It is an object of the present invention to provide a releasing composition having substantially no or low tendency of reducing flowability of toners.

It is another object of the present invention to provide a releasing composition capable of providing high HO without reducing flowability of toners.

It is still another object of the present invention to provide such a releasing composition, which can be easily dispersed into toners and is capable of providing improved electrostatic stability.

It is yet another object of the present invention to provide such a releasing composition, which can prevent oxidation during melt blending with use of smaller amount of antioxidant and can provide fade-resistant toner image.

Briefly, these and other objects of the present invention as hereinafter will become more readily apparent have been attained broadly by a releasing composition suitable for electrophotographic toner, which comprises at least one polyolefinic resin selected from the group consisting of

[1] a polypropylene resin having a melt viscosity of at most 1000 cps at 160° C. and having an isotactic content of at least 90%;

[2] an organo silane-modified polyolefin resin; and

[3] an organo fluorine-modified polyolefin resin.

DETAILED DESCRIPTION OF THE PREFERRED EMBODIMENTS

[1] Suitable polypropylene resins, having a melt viscosity of at most 1000 cps at 160° C. (degrees C.) and having an isotactic content of at least 90%, include:

1) those obtainable by thermal degradation of high molecular weight polypropylene resins having an isotactic content of at least 90%, and 2) those obtainable by solvent-extraction of low molecular weight polypropylene resins having a melt viscosity of at most 1000 cps at 160° C.

Suitable high molecular weight polypropylene resins having an isotactic content of at least 90%, used as the raw material for thermal degradation in the above 1), have a melt index of usually 0.1–100, preferably 1–50, and include propylene homopolymers and copolymers of propylene with one or more other olefins, for example, ethylene, and olefines containing 4–8 or more carbon atoms (such as butene and octene). The content of said other olefins is generally 20% or less, preferably 8% or less. (In the above and hereinafter, % represents % by weight, unless otherwise specified.) The content higher than 20% results in insufficient release properties. Thermal degradation can be accomplished, for example, by passing a high molecular weight polypropylene resin through a reaction vessel, such as a tubular reactor, capable of applying heat homogeneously, at a temperature of 300°–450° C. during 0.5–10 hours. The melt viscosity of thermally degaraded products can be controlled by the degradation temperature and the degradation period. When the temperature is less than 300° C., longer period of time is required to attain low melt viscosity; while it is difficult to control the melt viscosity on account of too rapid degradation at the temperature exceeding 450° C.

Solvent-extraction of low molecular weight polypropylene resins of the above 2) may be performed, for instance, by adding a solvent to low molecular weight polypropylene resin powder and heating them under stirring and under reflux, followed by, after cooling to the room temperature, removing soluble matters together with the solvent and drying the resulting insoluble matters. Suitable solvent include, for example, ketones, such as methyl ethyl ketone and acetone; ethers, such as dioxane; alcohols, such as methanol and ethanol; aromatic hydrocarbons, such as toluene and xylene; aliphatic hydrocarbons, such as pentane and heptane; halogenated hydrocarbons, such as chloroform and carbon tetrachlolide; and mixtures of two or more of them. Weight ratio of the solvent to the low molecular weight polypropylene resins is generally 0.5:1–20:1; and the period of heating under reflux is usually 1–5 hours. The higher the ratio of the solvent, and the longer the period of heating under reflux is; the more perfect extraction can be attained, but the lower the yield becomes.

In stead of or in conjunction with these polypropylene resins (thermally degraded products of high molecular weight polypropylene resins, and /or solvent-extracted low molecular weight polypropylene resins), there may be used maleic-modified derivatives (adducts with maleic monomers, for example, maleic anhydride, and maleic esters, such as dimethyl, diethyl and di-2-ethylhexyl maleates) of these (thermally degraded ones and/or solvent-extracted ones), and/or oxydates of these (thermally degraded ones and/or solvent-extracted ones).

Among these polypropylene resins, preferred are thermally degraded products of high molecular weight polypropylene resins.

Isotactic content of polypropylene resins used in the present invention is at least 90%, preferably at least 93%. Ones having isotactic content less than 90% result in insufficient flowability of toners. Isotactic content of polypropylene resins is determined by measuring absorbency at 998 $cm^{-1}$ ($D_{998}$) and absorbency at 974 $cm^{-1}$ ($D_{974}$) with an infrared spectrophotometer and calculated according to the following equation:

$$\text{Isotactic content } (\%) = D_{998}/D_{974} \times 100\%$$

Melt viscosity at 160° C. of polypropylene resins in this invention is at most 1000 cps, preferably at most 500 cps. Ones of melt viscosity higher than 1000 cps result in poor hot offset effects when used in toners. Melt viscosity at 160° C. is measured with a Brookfield rotational viscometer, under conditions in accordance with JIS-K1557-1970, except the measuring temperature. Temperature of the sample to be measured can be adjusted with an oil bath equipped with a temperature regulator.

[2] Organo silane-modified polyolefin resins include polyolefin resins modified with one or more organo silane compounds.

Suitable organo silane compounds used for modification include silane compounds having an olefinical unsaturation-containing group and/or a hydrolyzable group. Examples of such compounds are those represented by any of the general formulae (1), (2), (3), (4) or (5):

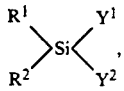
(1)

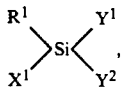
(2)

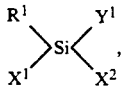
(3)

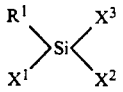
(4)

and

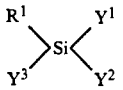
(5)

wherein $R^1$ and $R^2$ are the same or different olefinical unsaturation-containing organic groups; $X^1$, $X^2$ and $X^3$ are the same or different organic groups free from olefinical unsaturation; and $Y^1$, $Y^2$ and $Y^3$ are the same or different hydrolyzable organic groups.

Exemplery of olefinical unsaturation-containing organic groups $R^1$ and $R^2$ are alkenyl groups containing 1- 8 or more carbon atoms, such as vinyl, (meth)allyl (allyl and methallyl; similar expressions are used hereinafter) and butenyl groups; and unsaturated ester-containing groups, including (meth)acryloxy-$C_{1-8}$alkyl groups, such as $CH_2{=}C(CH_3)COO(CH_2)_3$—. Suitable organic groups $X^1$, $X^2$ and $X^3$ free from olefinical unsaturation include, for example, monovalent hydrocarbon groups (such as alkyl, aryl and aralkyl groups) containing 1–8 or more carbon atoms, such as methyl, ethyl, propyl, phenyl and benzyl groups; these hydrocarbon groups substituted with one or more halogen atoms, such as p-chlorophenyl group and the like. Examples of hydrolyzable organic groups $Y^1$, $Y^2$ and $Y^3$ include groups hydrolyzable when silanaized, for instance, $C_{1-8}$ (preferably $C_{1-4}$) alkoxy groups, such as methoxy, ethoxy and butoxy groups; alkoxyalkoxy groups containing up to 6 carbon atoms, such as methoxyethoxy group; $C_{2-9}$ acyloxy group, such as acetoxy and propioxy groups; amino-containing groups, such as amino-oxy and amino groups; halogens, such as chlorine, fluorine and bromine; and any other hydrolyzable organic groups. Among these hydrolyzable groups, preferred are $C_{1-4}$alkoxy groups.

Illustrative of suitable organo silane compounds are vinyltrimethoxy silane and gamma-(meth)acryloxypropyltrimethoxy silanes. Among these, the most preferred is vinyltrimethoxy silane.

Suitable polyolefin resins to be modified with said organo silane compounds include:

1) polyolefins, for example, polyethylene, ethylene-alpha-olefin ($C_{3-8}$) copolymers, such as those having ethylene content of at least 50%, particularly at least 70%, polypropylene, and propylene-alpha-olefin ($C_{4-8}$) copolymers, such as those having propylene content of at least 50%, particularly at least 70%;
2) maleic-modified derivatives (adducts with maleic monomers, for example, maleic anhydride, and maleic esters, such as dimethyl, diethyl and di-2-ethylhexyl maleates) of the above polyolefins 1);
3) oxydates of the above polyolefins 1); and
4) copolymers of olefines [for example, ethylenically unsaturated hydrocarbons containing 2–4 or more carbon atoms, such as ethylene, propylene and butene] with ethylenically unsaturated carboxylic acids [such as (meth)acrylic and itaconic acids] and/or esters thereof [such as alkyl ($C_{1-18}$) esters];

as well as mixtures of two or more of them.

Among these, preferred are polypropylene and propylene-alpha-olefin ($C_{4-8}$) copolymers, particularly those having isotactic content (determined as mentioned above) of at least 75%, in view of flowability of toners.

Organo silane-modified polyolefin resins can be prepared by any methods, for instance, by A) modifying a polyolefin resin of low melt viscosity with one or more organo silane compounds; or by B) modifying a polyolefin resin of high melt viscosity with one or more organo silane compounds and then thermally degrading the resulting modified polyolefin resin of high melt viscosity.

Polyolefin resins of low melt viscosity, in the above method A), may be prepared as follows:

1) polyolefins of low melt viscosity can be obtained by thermally degrading polyolefins of high melt viscosity [weight-average molecular weight (Mw): usually about 10,000–about 2,000,000] at a temperature of 300°–450° C. for 0.5–10 hours, or by low (co)polymerization of olefin(s) with or without other monomer(s) under known polymerization methods.
2) maleic-modified derivatives can be produced by addition reaction of maleic monomers to the above polyolefins 1) in the presence or absence of peroxide catalyst.
3) oxydates can be produced by oxidizing the above polyolefins 1) with oxygen or oxygen-containing gas (air), or with ozone-containing oxygen or ozone-containing gas (air). The resulting oxydates have an acid value of usually at most 100, preferably at most 50.
4) low melt viscosity copolymers of an olefin with an ethylenically unsaturated carboxylic acid and/or ester thereof can be prepared by copolymerization of these monomers. The amount of the ethylenically unsaturated carboxylic acid and/or ester thereof is generally at most 20%, preferably at most 20%.

Polyolefin resins of low melt viscosity can be modified with one or more organo silane compounds, in the presence or absence of peroxide catalyst. Suitable peroxide catalysts include, for example, benzoyl peroxide, lauroyl peroxide, di-t-butyl peroxide, t-butylcumyl peroxide, dicumyl peroxide, t-butylperoxybenzoate, 1,1-bis(t-butylperoxy)-3,3,5-trimethylcyclohexane, and the like. Modification is generally carried out within an atmosphere of inert gas, such as nitrogen. The reaction may be carried out at a temperature of usually between the melting point of polyolefin resins and 300° C., preferably 140°-200° C., for 1-20 hours.

Modification of polyolefin resins of high melt viscosity with one or more organo silane compounds, in the above method B), may be done in the same manner as above. The reaction temperature is usually between the melting point of polyolefin resins and 300° C., preferably 140°-200° C. The resulting organo silane-modified polyolefin resins of high melt viscosity can be thermally degraded at a temperature of 300°-450° C. for 0.5-10 hours.

Organo silane-modified polyolefin resins, as releasing agent, usually have a silicon atom content of 0.01-5%. Modified resins having a silicon atom content less than 0.01% do not provide sufficiently high HO. Modified resins of a silicon atom content exceeding 5% are liable to gel and result in toners of insufficient HO.

[3] Organo fluorine-modified polyolefin resins include polyolefin resins modified with one or more organo fluorine compounds.

Suitable organo fluorine compounds used for modification include fluorine compounds having an olefinical unsaturation-containing group, for example, fluorinated olefins containing 2-10 or more carbon atoms and 1-20 or more fluorine atoms, such as hexafluoropropylene and perfluorohexylethylene; fluorinated alkyl($C_{1-10}$ or more) (meth)acrylates, such as perfluorohexylethyl (meth)acrylates and perfluorooctylethyl (meth)acrylates, and the like. Among these, preferred are fluorinated alkyl (meth)acrylates, particularly perfluorohexylethyl methacrylate.

Organo fluorine-modified polyolefin resins can be prepared by any methods, for instance, by A) modifying a polyolefin resin of low melt viscosity with one or more organo fluorine compounds; or by B) modifying a polyolefin resin of high melt viscosity with one or more organo fluorine compounds and then thermally degrading the resulting modified polyolefin resin of high melt viscosity.

Polyolefin resins of low melt viscosity and of high melt viscosity, to be modified with said organo fluorine compounds in the above methods A) and B), may be the same ones as those to be modified with said organo silane compounds, as mentioned above, including 1) polyolefins, 2) maleic-modified derivatives of 1), 3) oxydates of 1), and 4) copolymers of an olefin with an ethylenically unsaturated carboxylic acid and/or ester thereof.

Polyolefin resins can be modified with one or more organo fluorine compounds, in the presence or absence of peroxide catalyst, such as those mentioned above for organo-silane modification. Modification may be carried out within an atmosphere of inert gas, under the same conditions as those of the above-mentioned organo-silane modification. Thermal degradation of organo fluorine-modified polyolefin resins of high melt viscosity can be carried out at a temperature of 300°-450° C. for 0.5-10 hours.

Organo fluorine-modified polyolefin resins, as releasing agent, usually have a fluorine atom content of 0.001-10%. When the fluorine atom content is less than 0.001%, the resulting toners are of poor flowability. Modified resins of a fluorine atom content higher than 10% are of poor melt properties and result in toners of insufficient HO.

Organo silane-modified polyolefin resins [2] and organo fluorine-modified polyolefin resins [3], used as releasing agent according to this invention, have a melt viscosity at 160° C. (measured as mentioned above) of usually at most 1000 cps, preferably at most 500 cps. Resins having a melt viscosity at 160° C. of more than 1000 cps provide toners of insufficient HO.

Mw of these polyolefinic resins (polypropylene resins [1] having an isotactic content of at least 90%, organo silane-modified polyolefin resins [2] and organo fluorine-modified polyolefin resins [3]), which can be measured by GPC using o-dichlorobenzene at 135° C., is generally about 1,000- about 100,000, preferably about 5,000- about 60,000.

Releasing compositions of the present invention, comprising at least one polyolefinic resin selected from the group consisting of [1] a polypropylene resin having a melt viscosity of at most 1000 cps at 160° C. and having an isotactic content of at least 90%, [2] an organo silane-modified polyolefin resin and [3] an organo fluorine-modified polyolefin resin, generally have a durometer hardness (according to ASTM D-2240) of at least 30, preferably at least 40. When the hardness is less than 30, the resulting toners become of poor flowability.

These olefinic resins preferably have a volume-average particle diameter of at most 10 microns, particularly 0.5-8 microns. Particles of more than 10 microns diameter result in poor dispersibility into toners; while particles less than 0.5 microns may causes agglomeration between particles and difficulty in handling. Olefinic resins having a volume-average particle diameter of at most 10 microns can be prepared, for instance, 1) by pulverizing the olefinic resin mechanically with a grinder (such as a jet mill, a wet milling grinder and the like); or 2) by adding a solvent to the olefinic resin powder and heating under high speed stirring to melt or dissolve them, followed by quenching and then drying to remove the solvent. In the method 2), suitable solvents include, for example, ketones, such as methylethylketone and acetone; ethers, such as dioxane; alcohols, such as methanol and ethanol; aromatic hydrocarbons, such as toluene and kylene; aliphatic hydrocarbons, such as pentane and heptane; chlorinated hydrocarbones, such as chloroform and carbontetrachloride; distilled water; and mixtures of two or more of them. Weight ratio of the solvent to the olefinic resin is usually 0.5:1-20:1. In general, heating is carried out at a temperature of 50° C.-250° C., for 1-5 hours. If necessary, depending upon the solvent, the solvent-resin mixture may be melted or dissolved under pressure.

In a preferable embodiment of the invention, releasing composition of this invention may contain at least one antioxidant. Illustrative of suitable antioxidants are aromatic compounds, for example, hindered phenols, such as triethyleneglycol-bis[3-(3-t-butyl-5-methyl-4-hydroxyphenyl) propionate], 1,6-hexanediol-bis[3-(3,5-di-t-butyl-4-hydroxphenyl) propionate], 2,4-bis(n-octylthio)-6-(4-hydroxy-3,5-di-t-butylanilino)-1,3,5-triazine, pentaerythrityl-tetrakis(3-(3,5-di-t-butyl-4-hydroxphenyl) propionate, 2,2-thiodiethylenebis[3-(3,5-di-t-butyl-4-hydroxyphenyl) propionate, octadecyl-3-(3,5-di-t-butyl-4-hydroxyphenyl) propionate, 2,2-thiobis(4-methyl-6-t-butyl-phenol, N,N'-hexamethylene-bis[3,5-di-t-butyl-4-hydroxylhydroxy-cinnamamide, 3,5-t-butyl-4-hydroxyl-benzyl phosphonate diethyl ester, 1,3,5-trimethyl-2,4,6-tris(3,5-di-t-butyl-4-hydroxybenzyl)benzene, and the like; sulphur compounds, for example, thiocarboxylic acids (such as thiopropionic acid and thiodipropionic acid) and esters thereof, such as dilauryl thiodipropionate, dimyristyl thiodipropionate, laurylstearyl thiodipropionate, distearyl thiodipropionate, 3,3-thiodipropionic acid, pentaerythritol tetra(beta-laurylthiopropionate), and the like; phosphorus compounds, for example, organic phosphites, phosphonites, phosphins, phosphonates and so on, such as tris(2,4-di-t-butylphenyl) phosphite, tetrakis(2,4-di-t-butylphenyl)-4,4'-biphenylene phosphonite, trilauryl phosphite, trioctadecyl phosphite, tristearyl phosphite, tris(2,4-t-butylphenyl) phosphite, tetrakis(2,4-di-t-butylphenyl)-4,4'-biphenylene diphosphonite, distearylpentaerythritol diphosphite, bis(2,4-t-butylphenyl)pentaerythritol diphosphite, 9,10-dihydro-9-oxa-10-phosphophenanthrene-10-oxide, triphenyl phosphine, calcium bis[3,5-di-t-butyl-4-hydroxylbenzyl phosphonate]. The content of said antioxidant is usually 1–10,000 ppm, preferably 10–36,000 ppm, based on the weight of the releasing composition. Addition of more than 10,000 ppm may make it difficult to control charge of toners. Said antioxidant may be added to polyolefinic resins (polypropylene resins [1], organo silane-modified polyolefin resins [2] and organo fluorine-modified polyolefin resins [3]) at any stages, for instance, during preparation of these polyolefinic resins of low melt viscosity (during thermal degradation or modifocation), or during preparation of precursor polyolefins of high melt viscosity.

Releasing compositions of the invention may contain optionally one or more of binders, colorants and various additives to form toners.

Suitable binders include thermoplastic resins, for example, styrenic resins, polyester resins, epoxy resins, poloyurethane resins, and the like.

Suitable styrenic resins include, for example, (co)-polymers of one or more styrenic monomers [such as styrene; and styrene homologues or substituted styrenes, including alkyl($C_1$–$C_8$)styrenes (such as alpha-methylstyrene, o-, m- and p-methylstyrenes, p-ethylstyrene, 2,4-dimethylstyrene, p-n-butylstyrene, p-t-butylstyrene, p-n-hexylstyrene, p-n-octylstyrene, p-n-nonylstyrene, p-n-decylstyrene, aryl-substituted styrenes (such as p-phenylstyrene), alkoxy-substituted styrenes (such as p-methoxystyrene), halogen-substituted styrenes (such as p-chlorostyrene, 3,4-dichlorostyrene); and mixtures of two or more of them (such as mixtures of styrene with one or more styrene homologues)]; and copolymers of (a) one or more these styrenic monomers with (b) one or more (meth)acrylic monomers [for example, esters of (meth)acrylic acids, for example, alkyl($C_1$–$C_{18}$) (meth)acrylates, such as methyl, ethyl, n- and i-butyl, propyl, n-octyl, 2-ethylhexyl, dodecyl, lauryl and stearyl (meth)acrylates; aryl (meth)acrylates, such as phenyl (meth)acrylates; hydroxyl-containing (meth-)acrylates, such as hydroxyethyl (meth)acrylates; amino-containing (meth)acrylates, such as dimethylaminoethyl and diethylaminoethyl (meth)acrylates; epoxy-containing (meth)acrylates, such as glycidyl (meth)acrylates; (meth)acrylic acids and derivatives thereof, such as (meth)acrylonitriles and (meth)acrylamides; and the like] and/or (c) one or more other monomers [for example, vinyl esters, such as vinyl acetate and vinyl propionate; aliphatic hydrocarbon monomers, such as alpha-olefins and butadiene; vinyl ethers, such as vinylmethyl ether, vinylethyl ether and vinyl-iso-butyl ether; vinyl ketones, such as vinylmethyl ketone, vinylhexyl ketone and methylisopropenyl ketone; N-vinyl compounds, such as N-vinylpyrrole, N-vinylcarbazole, N-vinylindole and N-vinylpyrrolidine; unsaturated carboxylic acids (such as maleic and itaconic acids) or derivatives thereof (such as anhydrides and esters); and the like], with or without (d) one or more one polyfunctional monomers containing at least two polymerizable double bonds [for example, aromatic di- or poly-vinyl compounds, such as divinylbenzene and divinyltoluene; di- or poly-(meth)acrylates of polyols, such as ethyleneglycol di(meth)acrylates, 1,6-hexanediol di(meth)acrylates; and so on]. Among monomers (a), preferred is styrene. Among monomers (b), preferred are alkyl (meth)acrylates and (meth)acrylic acids, particularly methyl, ethyl, butyl and 2-ethylhexyl (meth)acrylates. Among monomers (c), preferred are vinyl esters and aliphatic hydrocarbon monomers, particularly vinyl acetate and butadiene. Among monomers (d), preferred are divinylbenzene and 1,6-hexanediol diacrylate. In styrenic polymers, the contents of these monomers (a), (b), (c) and (d) can be varied widely, but the usual ranges are as follows: (a) 50–100%, preferably 60–98%; (b) 0–50%, preferably 5–40%; (c) 0–10%, preferably 0–5%; and (d) at most 0.1 mole %, preferably at most 0.05 mole %, based on the total monomers. Styrenic polymers may be produced using any known polymerization techniques, such as solution polymerization, suspension polymerization, bulk polymerization, emulsion polymerization, and combinations of them (such as solution polymerization followed by suspension or bulk polymerization, or suspension polymerization followed by solution or bulk polymerization). Polymerization can be carried out in the presence of one or more polymerization initiators, for example, azo compounds, such as azobis-iso-butyronitrile, azobis-isovaleronitrile, and the like; peroxides, such as those mentioned above for organo-silane modification; and so on. The amount of polymerization initiators can vary widely, but is generally 0.02–1.0%, preferably 0.03–0.8%, based on the total weight of the monomers. Polymerization is generally carried out within an atmosphere of inert gas, such as nitrogen atom, at a temperature of usually 50°–220° C., preferably 70°–200° C. Reaction period, which may be varied with other conditions, is usually 1–50 hours, preferably 2–10 hours. Illustrative examples of styrenic polymers are styrene/(meth)acrylate copolymers, such as styrene/butyl acrylate copolymers and styrene/butyl acrylate/divinylbenzene terpolymers (molar ratio of styrene/butyl acrylate=about 7/3), and styrene/-butadiene copolymers.

Suitable polyesters include, for example, polycondensation products of a polycarboxylic acid component with a polyol component, and ring-opening polymers of a lactone. Illustrative of suitable polycarboxylic acid components are aromatic dicarboxylic acids, such as terephthalic, isophthalic, phthalic, naphthalene dicarboxylic and trimellitic acids; esters and halides of these acids, such as dimethyl terephthalate and terephthalic dichloride; $C_2$–$C_{30}$ aliphatic dicarboxylic acids, such as malonic, succinic, adipic, sebacic and dodecane dicarboxylic acids; and esters and halides of these acids, such as dimethyl adipate and adipic dichloride. Among these, preferred are aromatic dicarboxylic acid and combination thereof with aliphatic dicarboxylic acid. Examples of suitable polyols include aliphatic diols, such as ethylene glycol, diethylene glycol, 1,2- and 1,3-propanediol, 1,4-butanediol, 1,6-hexanediol and neopentylglycol, and alcoholates (such as sodium alcoholate) of these diols; cycloaliphatic diols, such as cyclohexylene glycol, cyclohexane dimethanol and hydrogenated bisphenol A; aromatic diols, such as bisphenols (such as bisphenol A, aromatic diols, such as bisphenols (such as bisphenol A, bisphenol S and bisphenol F) and hydroquinone, and esters and alcoholates of these phenols (such as diacetylbisphenol A and bisphenol A disodium alcoholate); aliphatic polyols of 3-8 functionality, such as trimethylol propane, glycerine, pentaerythritol and the like; as well as alkylene oxide ($C_2$-$C_4$) adducts of these diols and polyols, such as EO and/or PO adducts of bisphenol A and EO and/or PO adducts of bisphenol F; polyalkyleneglycols, such as polyethyleneglycol, polypropyleneglycol and polytetramethyleneetherglycol. Among these, preferred are alkylene oxide adducts of aromatic diols, aliphatic diols and combinations of them, particularly alkylene oxide adducts of aromatic diols (especially propylene oxide adducts of bisphenol A). Suitable lactones include caprolactone. Polyesters may be hydroxyl-terminated or carboxyl-terminated. Illustrative of suitable polyester resins are polyesters of terephthalic acid with propylene oxide adducts of bisphenol A.

Suitable epoxy resins include conventionally employed ones, as described in "EPOXY RESINS" published 1957 by McGraw-Hill, for example, glycidyl ethers, including those of phenol or bisphenol ether type [adducts of epichlorhydrin with phenolic compounds, including aromatic diols, such as bisphenols (such as bisphenol A), phenol novolak, cresol novolak, resorcinol and the like], phenol epoxy resins, aromatic epoxy resins, cycloaliphatic epoxy resins, ether type epoxy resins (adducts of epichlorhydrin with polyols, polyether polyols and the like), such as polyol di- and tri-glycidyl ethers, and so on; and modified products of these epoxy resins (such as modified products of epichlorhydrin with bisphenol A). Among these, preferred are adducts of epichlorhydrin with bisphenol A. Epoxy resins usually have an epoxy equivalent of generally 140-4000, preferably 190-500. Illustrative of suitable epoxyresins include commercially available Epikote 1004 (produced by Shell), Araldite 6084 and 7072 (produced by Ciba-Geigy) and AER 664 (produced by Asahi Kasei).

Suitable polyurethanes are inclusive of reaction products of a diisocyanate component with a polyol component. Suitable diisocyanates include, for example, aromatic diisocyanates containing 6-20 carbon atoms (except carbon atoms in NCO groups), such as 2,4- and/or 2,6-tolylene diisocyanates and 4,4'- and/or 2,4'-diphenylmethane diisocyanates; cycloaliphatic diisocyanates containing 4-15 carbon atoms, such as isophorone diisocyanate and dicyclohexylmethane diisocyanate; aliphatic diisocyanates containing 2-18 carbon atoms, such as ethylene diisocyanate, tetramethylene diisocyanate, hexamethylene diisocyanate and lysine diisocyanate; araliphatic diisocyanates containing 8-15 carbon atoms, such as xylylene diisocyanate; and modified diisocyanates of these diisocyanates (such as modified ones containing urethane, carbodiimide, allophanate, urea, biuret, urethdione, urethonimine, isocyanurate and/or oxazolidone groups); as well as mixtures of two or more of them. Among these, preferred are aromatic diisocyanates. Examples of suitable polyols are the same ones as mentioned above for polyesters (aliphatic diols, triols, aromatic diols, alkylene oxide adducts thereof and polyalkyleneglycols, excepting esters and alcoholates); and polyester diols obtainable by polycondensation of a dicarboxylic acid component with a diol component as above, or by ring-opening polymerization of a lactone. Among these diols, preferred are alkylene oxide adducts of aromatic diols, aliphatic diols and combinations of them, particularly alkylene oxide adducts of aromatic diols (especially propylene oxide adducts of bisphenol A).

Among these binder resins, preferred are styrenic resins [particularly styrene/(meth)acrylic copolymers] and polyester resins.

Molecular weight of binder resins may vary widely; but preferred are those having a number-average molecular weight (Mn) of about 2,000-about 50,000 or higher, preferably about 3,000-about 30,000. Epoxy resins usually have Mn of about 200-about 10,000. Mw of binder resins is usually about 100,000-about 2,000,000, preferably about 150,000-about 1,500,000. When Mw is less than 100,000, it is difficult to obtain sufficient HO; and Mw higher than 2,000,000 results in too high MF. Molecular weight distribution [represented by the ratio of Mw to number-average molecular weight (Mn), that is Mw/Mn] of binder resins is generally at least about 20, preferably at least about 30. Mw/Mn less than 20 results in poor balance of HO and MF. Glass transition temperature (Tg) of binder resins is generally about 40°-about 80° C., preferably about 45°-about 70° C. Resins of Tg less than 40° C. provides toner of poor shelf stability; and when Tg is higher than 80° C., MF becomes too high to be used practically as toners.

Binder resin may be added beforehand to the releasing composition of this invention to obtain a resin composition for toners, or may be added together with the releasing composition during preparation of toners to obtain toners. Resin composition for toners usually contains at least 0.5% of the releasing composition of the invention. The releasing composition of this invention can be mixed with the binder resin by any known methods. The releasing composition may be added during polymerization (preparation of binder resin), or may be blended with the binder resin after polymerization, using a mixer. It is preferred that the releasing composition is homogeneously distributed in the resin composition, to obtain excellent release effects. For this purpose, the releasing composition is preferably added during polymerization.

Examples of suitable colorants and other additives include inorganic and organic pigments, such as carbon black, iron black, benzidine yellow, quinacridone pigments, rhodamine B, phthalocyanine pigments and the like; carrier particles, for example, magnetic powders, such as powders of ferromagnetic metals and compounds (such as iron, cobalt, nickel, magnetite, hematite, ferrite and the like), glass beads and the like; charge controllers, such as nigrosine, quaternary ammonium salts and metal complexes; lubricants (such as polytetrafluoroethylene, fatty acids and metal salts or amides thereof), plasticizers, hydrophobic colloidal silica powder and so on.

The amount of said releasing composition is usually at most about 30%, preferably about 1-about 20%, based on the total weight of the toner binder. Use of the releasing composition more than 30% results in insufficient dispersibility.

In electrophotographic toners, according to this invention, the contents of these components can be varied widely. In general, the ranges may be approximately as follows:

| | usually, % | preferably, % |
|---|---|---|
| releasing composition | 0.5-30 | 1-5 |
| toner binder | 45-95 | 70-90 |
| colorant | 3-20 | 5-10 |
| magnetic powder | 0-60 | 0-50 |
| charge controller | 0-10 | 0.5-5 |
| other additives | 0-10 | 0-5 |

Electrophotographic toner can be prepared by any known methods, for instance, 1) by dry blending these toner components and then melted under kneading, followed by crushing, and then finely pulverizing with a grinder (such as jet grinder), thereafter classifying to obtain particles (usually 5-20 microns diameter); or 2) by suspension-polymerizing monomers (precursors for the binder component) in the presence of the other toner components to obtain particles (usually 5-20 microns diameter).

Said toner can be optionally mixed with one or more carrier particles, such as iron powder, glass beads, nickel powder and ferrite, and used as a developer for electrical latent images. Besides, hydrophobic colloidal silica powder may be used to improve flowability of powders.

Said toner can be fixed on substrates (such as paper, polyester film and the like) to be used as recording materials. Fixation may be accomplished by any known fixation means, for example, heat roll fixation of copy machines, such as heat-fixation type copiers or printers.

Having generally described the invention, a more complete understanding can be obtained by reference to certain specific examples, which are included for purposes of illustration only and not intended to be limiting unless otherwise specified.

In the following examples, parts represent parts by weight; and melt viscosity is that measured at 160° C.

Binder I, used in the following Examples, were prepared by thermally polymerizing 660 parts of styrene and 340 parts of butyl acrylate at 130°-180° C., without using any solvent and polymerization initiator, and having Tg of 53° C., Mn of 11,000 and Mw of 70,000. The molecular weight was measured with GPC under following conditions:

Equipment: HCL-802A, produced by Toyo Soda Manuf.
Columns: TSK gel GMH6, 2 columns, produced by Toyo Soda Manuf.
Temperature: 25° C.
Sample solution: 0.5% THF solution.
Amount of solution: 200 microlitters.
Detector: Refractometer.

EXAMPLE 1

A high molecular weight polypropylene (isotactic content 93%) was continuously introduced into a tubular reaction vessel equipped with a static mixer and thermally degraded at 355°-360° C. for 80 minutes, to obtain a polypropylene resin (Releaser 1 of this invention) having an isotactic content of 96% and a melt viscosity of 70 cps.

EXAMPLE 2

To 100 parts of low molecular weight polypropylene powder ("Viscol 660P", produced by Sanyo Chemical Industries, Ltd., having an isotactic content 85% and a melt viscosity of 170 cps), was added 300 parts of toluene, and the mixture was heated to reflux under stirring. After cooled to the room temperature, toluene soluble matters were separated off through filtration to obtain a polypropylene resin (Releaser 2 of this invention) having an isotactic content of 93% and a melt viscosity of 240 cps.

COMPARATIVE EXAMPLE 1

Example 1 was repeated except that the high molecular weight polypropylene was thermally degraded at 345°-350° C. for 50 minutes, to obtain a polypropylene resin (Releaser 1' for comparison) having an isotactic content of 96% and a melt viscosity of 1500 cps.

EXAMPLE 3

Into a twin screw extruder preset to a barrel temperature of 120° C., was introduced a blend of 1000 parts of a high melt viscosity polypropylene, 20 parts of vinyltrimethoxysilane and 1 part of di-t-butylperoxide to obtain a modified polypropylene of high melt viscosity.

Then, 1000 parts of this modified polypropylene were continuously introduced into a tubular reaction vessel heated to 360° C. and thermally degraded for 30 minutes, to obtain a modified polypropylene resin (Releaser 3 of this invention) having a melt viscosity of 200 cps and a durometer hardness of 60.

EXAMPLE 4

Into a tubular reaction vessel heated to 360° C., were introduced 1000 parts of a high melt viscosity polypropylene, and thermally degraded for 30 minutes, to obtain a low melt viscosity polypropylene.

Into a reaction vessel substituted with nitrogen, 1000 parts of this thermally degraded polypropylene were charged and heated to 160° C., and then 20 parts of vinyltrimethoxysilane and 5 parts of di-t-butylperoxide were added thereto dropwise over 4 hours, followed by reacting them further 1 hour and then removing volatile matters under reduced pressure to obtain a modified polypropylene resin (Releaser 4 of this invention) having a melt viscosity of 60 cps and a durometer hardness of 60.

EXAMPLE 5

Example 2 was repeated except using, as the high melt viscosity polypropylene, that having isotactic content of 90% to obtain a modified polypropylene resin (Releaser 5 of this invention) having a melt viscosity of 65 cps and a durometer hardness of 70.

COMPARATIVE EXAMPLE 2

The same modified polypropylene of high melt viscosity as in Example 3 was continuously introduced into a tubular reaction vessel equipped with a static mixer and thermally degraded at 345°-350° C. for 50 minutes, to obtain a modified polypropylene resin (Releaser 2' for comparison) having a melt viscosity of 1500 cps and a durometer hardness of 65.

COMPARATIVE EXAMPLE 3

There was prepared the same polypropylene of low melt viscosity (Releaser 3' for comparison), as used in Example 4, having a melt viscosity of 60 cps and a durometer hardness of 55.

EXAMPLE 6

Example 3 was repeated except that vinyltrimethoxysilane was substituted with perfluorohexylethyl methacrylate, to obtain a modified polypropylene resin (Releaser 6 of this invention) having a melt viscosity of 200 cps and durometer hardness of 60.

EXAMPLE 7

Example 4 was repeated except that vinyltrimethoxysilane was substituted with perfluorohexylethyl methacrylate, to obtain a modified polypropylene resin (Releaser 7 of this invention) having a melt viscosity of 60 cps and durometer hardness of 60.

COMPARATIVE EXAMPLE 4

The same modified polypropylene of high melt viscosity as in Example 6 was continuously introduced into a tubular reaction vessel equipped with a static mixer and thermally degraded at 345°-350° C. for 50 minutes, to obtain a modified polypropylene resin (Releaser 4' for comparison) having a melt viscosity of 1500 cps and durometer hardness of 65.

EXAMPLE 8

To 3000 parts of toluene, were added 1000 parts of a low melt viscosity polypropylene having a melt viscosity of 60 cps, and heated to reflux for 1 hour under stirring at 1000 r.p.m. to be dissolved. After quenching to the room temperature, the precipitated particles were filtered off and then washed with methanol, followed by removing the solvent under reduced pressure at 40° C. for 10 hours to obtain a polypropylene resin particle (Releaser 8 of this invention) having a volume-average diameter of 2 microns, a melt viscosity of 240 cps and a durometer hardness of 55.

EXAMPLE 9

To 1000 parts of a low melt viscosity polypropylene having a melt viscosity of 60 cps melted under heating to 150° C., 10 parts of vinyltriethoxysilane and 10 parts of di-t-butylperoxide were added thereto dropwise over 4 hours. After maintaining the temperature at 150° C. for 1 hour, 300 parts of xylene were added thereto and heated for additional 1 hour under stirring at 1000 r.p.m. After quenching to the room temperature, the precipitated particles were filtered off and then washed with methanol, followed by removing the solvent under reduced pressure at 40° C. for 10 hours to obtain a modified polypropylene resin particle (Releaser 9 of this invention) having a volume-average diameter of 3.5 microns, a melt viscosity of 85 cps and a durometer hardness of 58.

COMPARATIVE EXAMPLE 5

There was prepared the same polypropylene of low melt viscosity (Releaser 5' for comparison), as used in Example 8, having a volume-average diameter of 50 microns, a melt viscosity of 60 cps and a durometer hardness of 53.

EXAMPLE 10

To 1000 parts of a high melt viscosity polypropylene, was added 0.1 part of tris(2,4-di-t-butylphenyl) phosphite, the polypropylene was thermally degraded at 350° C. for 1 hour to obtain a polypropylene resin composition (Releaser 10 of this invention) having a melt viscosity of 90 cps and durometer hardness of 50.

EXAMPLE 11

To a low melt viscosity polypropylene obtained by thermally degrading 1000 parts of a high melt viscosity polypropylene at 350° C. for 1 hour, was added 1 part of calcium bis(ethyl 3,5-di-t-butyl-4-hydroxylbenzylphosphonate) to obtain a polypropylene resin composition (Releaser 11 of this invention) having a melt viscosity of 50 cps and durometer hardness of 47.

COMPARATIVE EXAMPLE 6

There was prepared the same polypropylene of low melt viscosity (Releaser 6' for comparison), as used in Example 11, having a melt viscosity of 50 cps and a durometer hardness of 46.

EXAMPLE 12

To 1000 parts of Releaser 10, were added 660 parts of styrene and 340 parts of butyl acrylate, and they were thermally polymerized at 130°-180° C., without using any solvent and polymerization initiator, to obtain a resin composition (Releaser 12 of this invention).

EXAMPLES I-XII and I'-VI'

Using these releasers and Binder I, toners for electrophotography and an electrophosographic developers were produced and evaluated as follows:

| (1) Preparation of toner | parts |
|---|---|
| Binder I | 87 |
| Releaser written in Table 1 | 4*3 |
| Carbon black*1 | 8 |
| Charge controller*2 | 1 |

*1MA-100, produced by Mitsubishi-kasei Co.
*2Spiron black TRH, produced by Hodogaya Chemical Co.
*3 6 parts in Examples X, XI and VI'; 12 parts in Example XII.

The above ingredients was powder dryblended, and kneaded with a laboplast mill at 140° C. at 30 rpm for 140° C., followed by finely pulverizing the kneaded mixture with a jet mill and then classifying with a dispersion separator (MSD, produced by Nippon Pneumatic Mfg. Co., Ltd.) to cut fine powders of less than 2 microns diameter. To 1000 parts of the resulting powder, 3 parts of a colloidal silica powder (Aerosil R972, produced by Japan Aerosil Co.) were added and homogeneously mixed to obtain a toner.

(2) Preparation of developer

To 25 parts of each toner as above, 1000 parts of a iron powder carrier (F-100, produced by Nippon Seihun Co.) were added and mixed to obtain a developer.

(3) Evaluation a) Flowability: Flow index (FI) was measured with a powder tester, produced by Hosokawa Micron, Co.

b) Anti-hot offset property: using a commercially available electrophotographic copy machine of heat fixation type, HO (the temperature causing offset to the heated roller) was measured, or occurrence of hot offset at heat roll temperature of 230° C. was observed with eyes.

c) Filming to carrier: after mixing developer with a turbula shaker mixer at 100 r.p.m. for 3 hours, the amount of toner adhered on the surface of carrier was observed with a microscope.

d) Electrostatic stability: using a blow-off powder charge measuring equipment, triboelectric charge ($Q_1$) at 500 sheets copying and triboelectric charge ($Q_2$) at 10000 sheets copying were measured, and the stability was shown by the absolute value of $[1-Q_1/Q_2]$.

The results were as shown in Tables 1 and 2.

TABLE 1

| Example | Releaser | FI | HO, °C. | Filming |
|---|---|---|---|---|
| I | Releaser 1 | >80 | >220 | little |
| II | Releaser 2 | >80 | >220 | little |
| I' | Releaser 1' | >80 | <220 | much |
| II' | Viscol 660P* | <70 | >220 | much |
| III | Releaser 3 | >80 | >220 | — |
| IV | Releaser 4 | >80 | >220 | — |
| V | Releaser 5 | >85 | >220 | — |
| III' | Releaser 2' | >80 | <200 | — |
| IV' | Releaser 3' | <70 | >200 | — |
| VI | Releaser 6 | >80 | >220 | — |
| VII | Releaser 7 | >80 | >220 | — |
| V' | Releaser 4' | >80 | <200 | — |

*a low molecular weight polypropylene, produced by Sanyo Chemical Industries, Ltd.

TABLE 2

| Example | Releaser | FI | Offset at 230° C. | $\lvert 1 - Q_1/Q_2 \rvert$ |
|---|---|---|---|---|
| VIII | Releaser 8 | >80 | No offset | <0.1 |
| IX | Releaser 9 | >80 | No offset | <0.1 |
| V' | Releaser 5' | <70 | Slightly offest | >0.3 |
| X | Releaser 10 | >80 | No offset | <0.1 |
| XI | Releaser 11 | >80 | No offset | <0.1 |
| XII | Releaser 12 | >80 | No offset | <0.1 |
| VI' | Releaser 6' | <70 | Slightly offset | >0.3 |

Examples I–XII are within the scope of the invention, and Examples I'–VI' are Comparative Examples.

Releasing compositions containing organo silane-modified or organo fluorine-modified polyolefin resins according to the present invention can provide toners having improved anti-hot offset properties without reducing flowability.

Releasing compositions containing polypropylene resins having a melt viscosity of at most 1000 cps at 160° C. and having an isotactic content of at least 90%, in accordance with this invention, not only can provide toners having excellent flowability, anti-hot offset properties and low temperature fixability, but also can prevent effectively toner adhesion (filming) towards carrier to attain toners having low tendency of filming towards carrier.

Releasing compositions containing polyolefinic resins having a melt viscosity of at most 1000 cps at 160° C., a volume-average particle diameter of at most 10 microns and having a durometer hardness of at least 30%, according to this invention, not only can provide toners having excellent flowability, give improved anti-hot offset properties, in addition to anti-hot offset properties without lowering flowability, In releasing compositions comprising anti-oxydants and polyolefinic resins having a melt viscosity of at most 1000 cps at 160° C. and having a durometer hardness of at 30, according to the invention, the anti-oxidant can be homogeneously dispersed into toners with the aid of said polyolefinic resins acting also as pigment dispersants, and can function effectively towards discoloration of pigments, whereby the amount of the anti-oxidant to be added can be minimized. Thus, these releasing compositions can produce toners having improved anti-hot offset properties and also improved electrostatic stability, without reducing flowability.

I claim:

1. An electrophotographic toner, which comprises: a toner binder resin, a colorant and a releasing composition containing at least one polyolefinic resin selected from the group consisting of (1) a maleic-modified or oxidized polypropylene resin having a melt viscosity of at most 1000 cps at 160° C. and having an isotactic content of at least 90%;

(2) an organo silane-modified polyolefin resin containing 0.01–5% by weight of silicon atom, said polyolefin being selected from the group consisting of polyethylene, ethylene-alpha-olefin ($C_{3-6}$) copolymers having at least 50% ethylene, propylene, propylene-alpha-olefin ($C_{4-8}$) copolymers having at least 50% propylene, maleic-modified adducts of said polyolefins, oxydates of said polyolefins and copolymers of ethylenically unsaturated $C_{2-4}$ hydrocarbons with ethylenically unsaturated carboxylic acids or $C_1$–$C_{18}$ esters thereof; said organo silane being a silane compound having an ethylenically unsaturated hydrocarbon group, wherein said organosilane compound and said polyolefin are reacted by radical polymerization; and (3) an organo fluorine-modified polyolefin resin containing 0.001–5% by weight of fluorine atom, said polyolefin being selected from the group consisting of polyethylene, ethylene-alpha-olefin ($C_{3-6}$) copolymers having at least 50% ethylene, propylene, propylene-alpha-olefin ($C_{4-8}$) copolymers having at least 50% propylene, maleic-modified adducts of said polyolefins, oxydates of said polyolefins and copolymers of ethylenically unsaturated $C_{2-4}$ hydrocarbons with ethylenically unsaturated carboxylic acids or $C_1$–$C_{18}$ esters thereof; said organo fluorine being a fluorine compound having an ethylenically unsaturated hydrocarbon group, wherein said organo fluorine compound and said polyolefin are reacted by radical polymerization.

2. The toner of claim 1, wherein said polypropylene resin contains at most 20% by weight of ethylene units.

3. The toner of claim 1, wherein said polypropylene resin is obtained by thermal degradation of a high molecular weight polypropylene having an isotactic content of at least 90%, or by solvent extraction of a low molecular weight polypropylene having a melt viscosity of at most 1000 cps at 160° C. and having an isotactic content of less than 90%.

4. The toner of claim 1, wherein said polypropylene resin is a propylene homopolymer, or a copolymer of propylene with up to 20% by weight of at least one other olefin selected from the group consisting of ethylene, butene and octene.

5. The toner of claim 1, wherein said polyolefinic resin is one modified with at least one monomer selected from the group consisting of ethylenically unsaturated carboxylic acids and derivatives thereof.

6. The toner of claim 1, wherein said polyolefinic resin is one modified with at least one monomer selected from the group consisting of maleic acid, maleic anhydride and maleic esters.

7. The toner of claim 1, wherein said organo silane compound is at least one compound selected from the group consisting of compounds represented by any of the general formulae (1), (2), (3), (4) and (5):

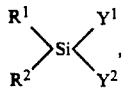
(1)

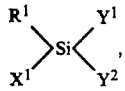
(2)

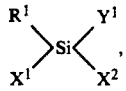
(3)

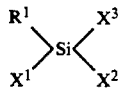
(4)

and

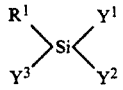
(5)

wherein $R^1$ and $R^2$ are the same or different olefinical unsaturation-containing organic groups; $X^1$, $X^2$ and $X^3$ are the same or different organic groups free from olefinical unsaturation; and $Y^1$, $Y^2$ and $Y^3$ are the same or different hydrolyzable organic groups.

8. The toner of claim 1, wherein said organo fluorine compound is at least one compound selected from the group consisting of fluorinated olefins and fluorinated alkyl esters of ethylenically unsaturated carboxylic acid.

9. The toner of claim 1, wherein said organo silane compound or said organo fluorine-modified polyolefin resin has a melt viscosity of at most 1000 cps at 160° C. and an isotactic content of at least 90%.

10. The toner of claim 1, which comprises said organo fluorine-modified polyolefin resin and a polyolefin resin.

11. The toner of claim 10, wherein said polyolefin resin has a melt viscosity of at most 1000 cps at 160° C. and an isotactic content of at least 90%.

12. The toner of claim 1, which has a durometer hardness of at least 30.

13. The toner of claim 1, which further contains 0.1–10%, based on the weight of the composition, of a polysiloxane compound.

14. The toner of claim 1, wherein the toner binder resin comprises at least one thermoplastic resin.

15. The toner of claim 1, comprising 0.5–30% by weight of the releasing composition, 45–95% by weight of a toner binder resin and 3–20% by weight of a colorant.

16. A method of fixing a toner image by means of a fuser roller, the toner image consisting essentially of a toner, which comprises the toner of claim 1.

17. The toner of claim 1, wherein the releasing composition comprises a polyolefinic resin having a melt viscosity of at most 1000 cps at 160° C. and a durometer hardness of at least 30, and 1–10,000 ppm, based on the weight of the releasing composition, of an antioxidant.

18. The toner of claim 1, wherein the releasing composition comprises a polyolefinic resin having a melt viscosity of at most 1000 cps at 160° C. and a volume-average diameter of at most 10 microns.

* * * * *